US006468002B1

(12) United States Patent
Gregory et al.

(10) Patent No.: US 6,468,002 B1
(45) Date of Patent: Oct. 22, 2002

(54) FOUNDATION SUPPORTING AND LIFTING SYSTEM AND METHOD

(75) Inventors: Steven D. Gregory, Plano, TX (US); Rick D. Sykes, Durham, NC (US)

(73) Assignee: Ramjack Systems Distribution, L.L.C., Ada, OK (US)

( * ) Notice: Subject to any disclaimer, the term of this patent is extended or adjusted under 35 U.S.C. 154(b) by 0 days.

(21) Appl. No.: 09/690,792

(22) Filed: Oct. 17, 2000

(51) Int. Cl.[7] ..... E02D 5/00
(52) U.S. Cl. ..... 405/230; 405/229; 254/29 R
(58) Field of Search ..... 405/230, 229, 405/231, 232; 254/29 R, 133 R

(56) References Cited

U.S. PATENT DOCUMENTS

| | | | | |
|---|---|---|---|---|
| 4,673,315 A | | 6/1987 | Shaw et al. | 405/230 |
| 4,695,203 A | | 9/1987 | Gregory | 405/230 |
| 4,754,588 A | | 7/1988 | Gregory | 52/294 |
| 4,765,777 A | | 8/1988 | Gregory | 405/230 |
| 4,911,580 A | | 3/1990 | Gregory et al. | 405/230 |
| 4,925,345 A | * | 5/1990 | McCown, Jr. et al. | 405/232 |
| 5,066,168 A | | 11/1991 | Holdeman | 405/249 |
| 5,120,163 A | | 6/1992 | Holdeman et al. | 405/230 |
| 5,139,368 A | | 8/1992 | Hamilton et al. | 405/230 |
| 5,171,107 A | | 12/1992 | Hamilton et al. | 405/230 |
| 5,176,472 A | * | 1/1993 | Kinder | 405/230 |
| 5,213,448 A | | 5/1993 | Seider et al. | 405/230 |
| 5,246,311 A | * | 9/1993 | West et al. | 405/230 |
| 5,253,958 A | * | 10/1993 | Bellemare | 405/232 |
| 5,492,437 A | * | 2/1996 | Ortiz | 405/230 |
| 5,722,798 A | | 3/1998 | Gregory | 405/230 |
| 5,951,206 A | | 9/1999 | Gregory | 405/230 |
| 6,079,905 A | * | 6/2000 | Ruiz et al. | 405/230 |
| 6,152,654 A | * | 11/2000 | Ruiz et al. | 405/232 |

* cited by examiner

*Primary Examiner*—Heather Shackelford
*Assistant Examiner*—Frederick L. Lagman
(74) *Attorney, Agent, or Firm*—Baker Botts L.L.P.

(57) ABSTRACT

A system and method for supporting a pier-supported structure includes a pier support assembly for engaging a pier of the structure. The system also includes a guide assembly coupled to the pier support assembly and a piling extending through the guide assembly. The system further includes a clamp assembly adapted to engage the piling upon downward movement of the piling and a drive system coupled to the clamp assembly and the pier support assembly. The drive system is operable to drive the piling downward relative to the pier support assembly until the piling encounters a predetermined resistance.

68 Claims, 8 Drawing Sheets

FOUNDATION SUPPORTING AND LIFTING SYSTEM AND METHOD

TECHNICAL FIELD OF THE INVENTION

This invention relates in general to the field of building foundations and, more particularly, to a foundation support and lifting system and method.

BACKGROUND OF THE INVENTION

Houses and other buildings or structures are often erected on foundations, such as concrete slabs or piers, which are not in direct contact with load supporting underground strata, such as bedrock or the like. If not initially constructed properly, or if soil conditions change, the foundation may settle, causing the foundation to move, sag and/or crack. Unless the building is supported, or shored, continued settling may result in major structural damage or collapse of the building.

There have been several suggestions in the prior art for supporting and lifting the foundation of a building. For example, according to one technique, beam members, or the like, are placed underneath the foundation and lifted to raise the foundation. However, this requires significant excavation of the ground area around the foundation which is very time consuming and labor intensive. Also, according to another technique, the foundation is lifted, or jacked up, and pilings are inserted underneath the foundation to support the foundation. However, the pilings are often not directly supported on the bedrock or other supporting underground strata, resulting in continued settling after the pilings are in place.

In still another technique utilizing pilings, in cooperation with a concrete slab, a support arm is placed beneath the concrete slab and pilings are inserted into the ground until bedrock or other supporting underground strata is contacted. Once the piling contacts the underground support strata, the lifting arm may be used to lift or support the concrete slab. However, the lifting arm is generally limited to concrete slabs.

SUMMARY OF THE INVENTION

Accordingly, a need has arisen for an improved foundation support and lifting system and method that provides increased flexibility to accommodate various foundation designs. The present invention provides an improved foundation support and lifting system and method that addresses shortcomings of prior systems and methods.

According to one embodiment of the present invention, a system for supporting a pier-supported structure includes a pier support assembly for engaging a pier of the structure and a guide assembly coupled to the pier support assembly. The system also includes a piling extending through the guide assembly and a clamp assembly adapted to engage the piling upon downward movement of the piling. The system further includes a drive system coupled to the clamp assembly and the pier support assembly. The drive system is operable to drive the piling downward relative to the pier support assembly until the piling encounters a pre-determined resistance.

According to another embodiment of the present invention, a method for supporting a pier-supported structure includes securing a pier support assembly to a pier of the structure and inserting a piling through a support sleeve of the pier support assembly. The method also includes coupling a clamp assembly to the piling. The clamp assembly is operable to engage the piling upon downward movement of the piling. The method further includes coupling a drive system to the clamp assembly in and the pier support assembly and actuating the drive system to drive the piling downward relative to the pier support assembly until the piling encounters a pre-determined resistance.

The present invention provides several technical advantages. For example, the present invention provides a foundation support and lifting system and method that accommodates various foundation designs. For example, according to one aspect of the present invention, a pier support assembly is provided to engage a pier of a pier-supported structure. Pilings are coupled to the pier support assembly and extend downwardly to low-bearing bedrock or other supporting underground strata. The system and method may be used to support the piers of the pier-supported structure in an existing position or may be used to raise the pier relative to the ground to realign various portions of the pier-supported structure.

Other technical advantages will be readily apparent to one skilled in the art from the following figures, descriptions, and claims.

BRIEF DESCRIPTION OF THE DRAWINGS

For a more complete understanding of the present invention and the advantages thereof, reference is now made to the following descriptions taken in connection with the accompanying drawings in which.

DETAILED DESCRIPTION OF THE INVENTION

Figure 1:
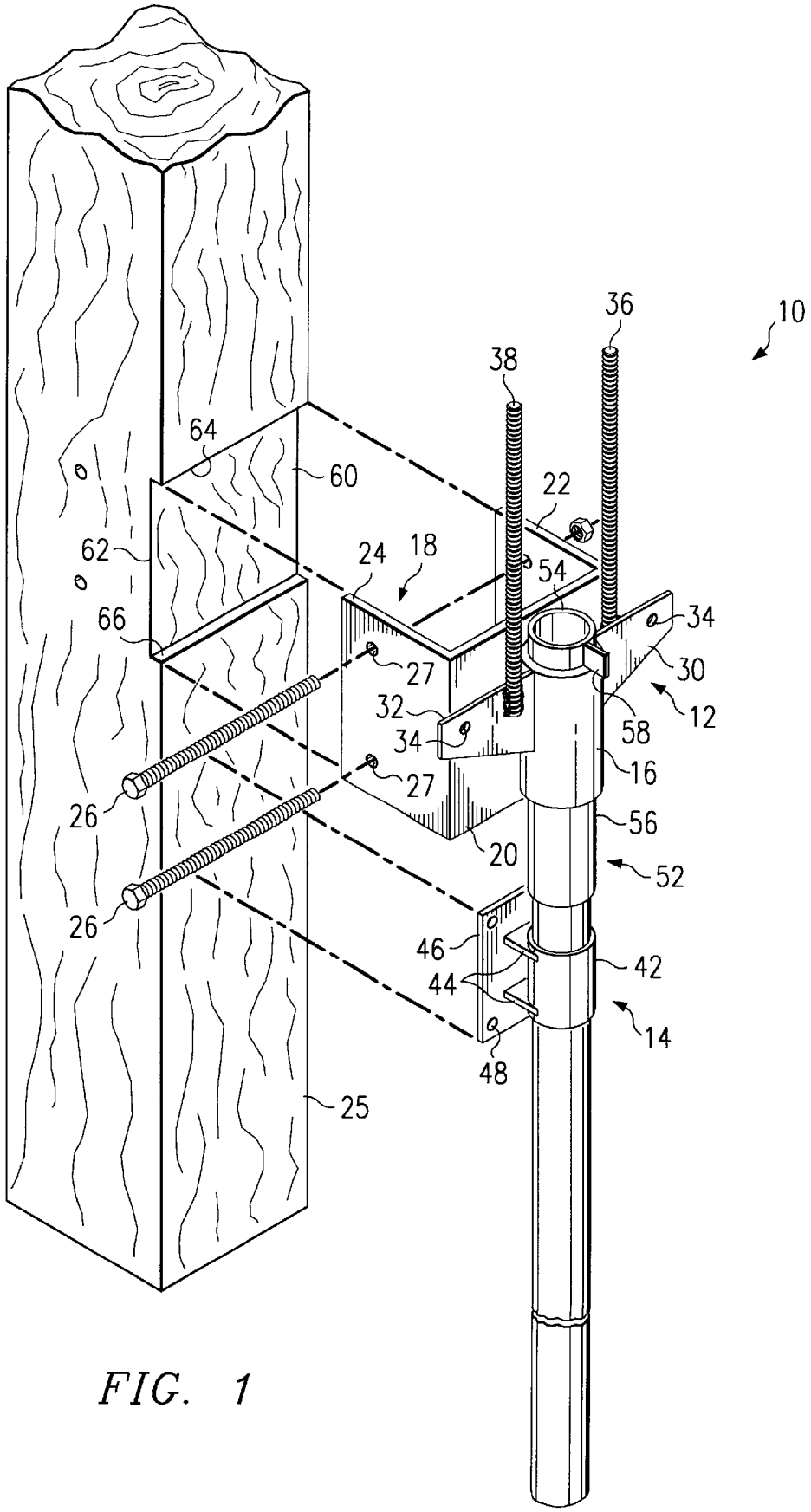
FIG. 1 is a diagram illustrating a perspective view of a system for supporting and lifting a pier-supported structure in accordance with an embodiment of the present invention.

FIG. 1 is a diagram illustrating a system 10 for supporting and lifting a pier-supported structure (not explicitly shown). System 10 includes a pier support assembly 12 and a standoff assembly 14. Pier support assembly 12 includes a support sleeve 16 having a channel 18 coupled thereto. Channel 18 includes a base member 20 coupled to support sleeve 16 and opposing sidewalls 22 and 24 extending outwardly and substantially perpendicular to base member 20. Sidewalls 22 and 24 are adapted for engagement with a pier 25 of the pier-supported structure using fasteners 26 extending through openings 27 of sidewalls 22 and 24 and pier 25. However, other suitable devices or methods may be used to secure channel 18 to pier 25. Additionally, channel 18 may be secured to support sleeve 16 using any conventional manner, such as welding.

A pair of attachment plates 30 and 32 are connected to diametrically opposed outer surfaces of support sleeve 16. Each attachment plate 30 and 32 includes an opening 34 extending therethrough for connection of a drive system, as will be described in greater detail below. A pair of threaded rods 36 and 38 are coupled to plates 30 and 32, respectively, and extend upwardly therefrom. Plates 30 and 32 and rods 36 and 38 may be coupled to support sleeve 16 by welding; however, other suitable methods may be used for securing plates 30 and 32 and rods 36 and 38 to support sleeve 16.

Standoff assembly 14 includes a support sleeve 42, support arms 44, and a mounting plate 46. Standoff assembly 14 is disposed in a spaced apart relationship relative to pier support assembly 12 such that support sleeve 42 is disposed in a coaxial relationship with support sleeve 16. Support arms 44 are coupled to support sleeve 42 and extend outwardly and substantially perpendicular thereto. Mounting plate 46 is coupled to support arm 44 and is adapted for engagement with the pier. For example, mounting plate 46 may include openings 48 extending therethrough for coupling mounting plate 46 to the pier using fasteners (not explicitly shown); however, other devices or methods may be used to secure standoff assembly 14 to the pier.

A guide assembly 52 extends through support sleeve 16 and includes an upper end portion 54 extending upwardly relative to support sleeve 16 and a lower end portion 56 extending downwardly relative to support sleeve 16 toward standoff assembly 14. A lip 58 is coupled to upper end portion 54 of guide assembly 52 and engages the upper end of support sleeve 16 to maintain guide assembly 52 in the position illustrated in FIG. 1.

In the embodiment illustrated in FIG. 1, an attachment profile 60 is formed in pier 25 to accommodate attachment of pier support assembly 12 to pier 25. For example, attachment profile 60 may comprise a notch 62 formed on a surface of pier 25 corresponding to the location of channel 18 such that base member 20 of channel 18 engages vertical portions 64 and 66 of pier 25. Thus, attachment profile 60 provides additional vertical support of pier 25 for supporting or lifting pier 25 as will be described in greater detail below.

Figure 2:
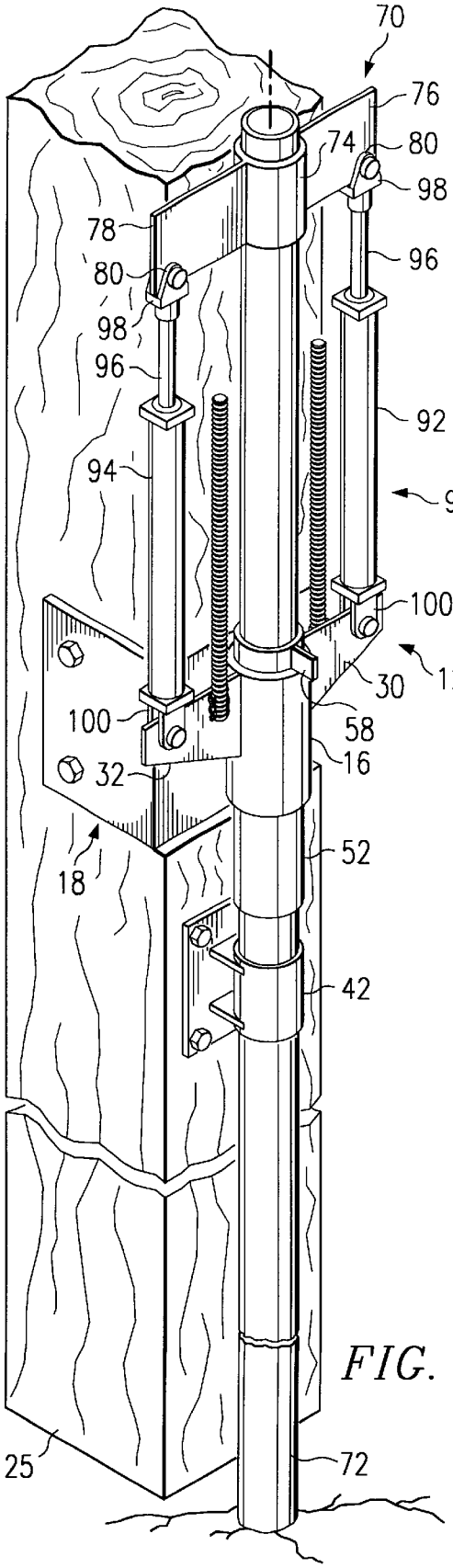
FIGS. 2–3 are diagrams illustrating perspective views of the system illustrated in FIG. 1 in various stages of operation.

FIG. 2 is a diagram illustrating system 10 illustrated in FIG. 1 mounted to pier 25. As illustrated in FIG. 2, system 10 also includes a clamp assembly 70 for engaging a piling 72 during downward movement of piling 72. Clamp assembly 70 includes a gripping sleeve 74 in the form of a conventional "slip bowl" for grabbing or clamping piling 72. Gripping sleeve 74 includes three inner arcuate inserts (not explicitly shown) which are tapered in a vertical direction so that the inserts grab or clamp piling 72 during downward movement of piling 72. A pair of plates 76 and 78 are coupled to, and extend outwardly from, diametrically opposing surfaces of gripping sleeve 74. Each plate 76 and 78 includes an opening 80 extending therethrough.

System 10 also includes a drive system 90 for driving piling 72 downward relative to pier support assembly 12 and into the ground. In the embodiment illustrated in FIG. 2, drive system 90 includes a pair of hydraulic ram units 92 and 94 coupled to plates 76 and 78 and attachment plates 30 and 32, respectively. Ram units 92 and 94 each include an arm 96 connected to pistons (not explicitly shown) which reciprocate in ram units 92 and 94 in response to actuation of ram units 92 and 94. This reciprocal movement of the pistons causes corresponding movement of arms 96 between an extended position as illustrated in FIG. 2 and a retracted position as described in greater detail below.

Ram units 92 and 94 each include a devise 98 connected to a respective arm 96. Clevises 98 extend over plates 76 and 78 and are coupled to plates 76 and 78 using fasteners extending through openings 80. In a similar manner, a pair of devises 100 are connected to the lower ends of ram units 92 and 94, and are connected to attachment plates 30 and 32 using fasteners extending through openings 34.

An inner diameter of gripping sleeve 74 of clamp assembly 70 is sized to received piling 72 in a relative close fit while allowing sufficient slidable movement of piling 72 relative to gripping sleeve 74. Piling 72 may include a plurality of pipe segments connected together in a conventional manner.

Due to the tapered configuration of the above-described arcuate inserts, clamp assembly 70 can be lifted upwardly relative to piling 72 without encountering substantial resistance. When ram units 92 and 94 are actuated, arms 96 retract from an extended position, thereby causing clamp assembly 70 to grab or clamp the outer surface of piling 72 and draw or drive piling 72 downwardly.

To install system 10, system 10 is placed adjacent pier 25 and pier support assembly 12 and standoff assembly 14 are secured to pier 25. Although only one system 10 will be described, it is understood that, in actual practice, several additional systems 10 may be located adjacent other piers 25 of the pier-supported structure to operate simultaneously with or in cooperation with each other.

Guide assembly 52 is inserted through support sleeve 16 until lip 58 engages the upper end of support sleeve 16. A section of piling 72 is then inserted into support sleeve 16 and support sleeve 42 until piling 72 is in contact with the ground. Clamp assembly 70 is then placed over the upper portion of piling 72. Ram units 92 and 94, in respective extended positions as illustrated in FIG. 2, are then installed between plates 76 and 78 and attachment plates 30 and 32, respectively.

Ram units 92 and 94 are then actuated simultaneously to cause a retracting motion of their corresponding pistons and arms 96, causing clamp assembly 70 to grab or clamp piling 72 and force piling 72 downward relative to pier support assembly 12 and into the ground for a predetermined distance. Ram units 92 and 94 are then simultaneously actuated back to their respective extended positions, thereby moving clamp assembly 70 upwardly to an upper portion of piling 72, and the sequence is repeated. During this sequential driving of piling 72 into the ground, additional pipe segments may be added to piling 72 as needed.

Figure 3:
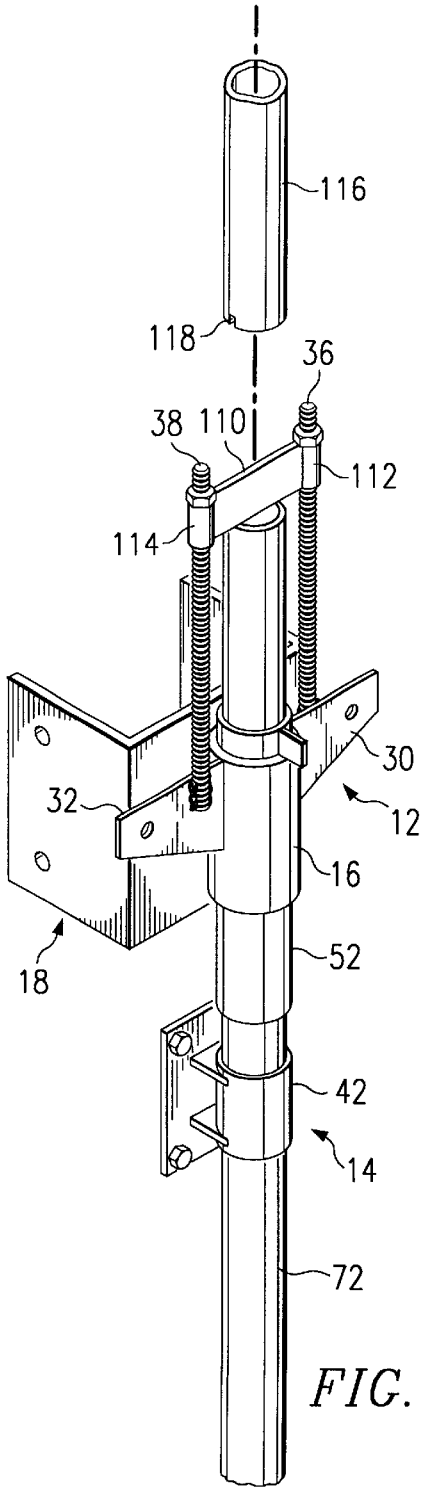
Figure 4:
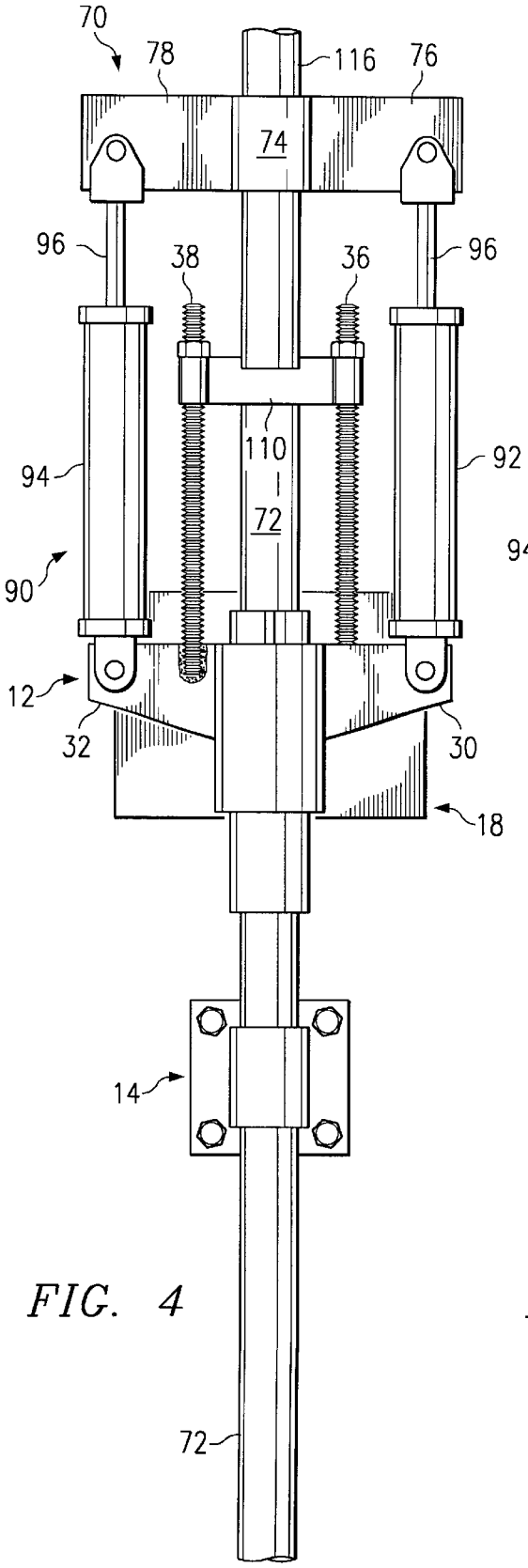
FIGS. 4–5 are diagrams illustrating elevational views of the system illustrated in FIGS. 1–3 illustrating additional stages of operation in accordance with an embodiment of the present invention.

The above-described procedure is repeated until the lower end portion of piling 72 encounters a predetermined resistance in the ground, which is usually in the form of bedrock or other support strata, in which case the aforementioned driving movement is terminated and the procedure depicted in FIGS. 3–4 is initiated. More particularly, the upper portion of piling 72 is removed so that a relatively short portion thereof, generally a few inches, extends above the upper end of guide assembly 52. A support member 110 having two sleeves 112 and 114 disposed at opposite ends thereof is positioned over the upper end of piling 72 with sleeves 112 and 114 extending over rods 36 and 38, respectively. A drive pipe segment 116 is then placed over support member 110. Support member 110 may also include notches 118 for engaging an upper portion of support member 110.

As illustrated in FIG. 4, clamp assembly 70 and drive system 90 are installed in the manner described above in connection with FIG. 2 with gripping sleeve 74 extending over pipe segment 116. Arms 96 are disposed in an extended position for grasping an upper end portion of pipe segment 116. Ram units 92 and 94 are then retracted from the extended position to exert a downwardly directed force against pipe segment 116, support member 110, and piling 72. Since piling 72 can no longer be driven downwardly due to the predetermined resistance encountered, such as by the bedrock, pier 25 will be lifted a desired amount causing pier support assembly 12 and standoff assembly 14 to move upwardly relative to piling 72, support member 110, pipe segment 116, and the ground to the position shown in FIG. 5. Thus, support member 110 is spaced apart from its original position on rods 36 and 38 a distance corresponding to the distance of the lift of pier 25.

Figure 5:
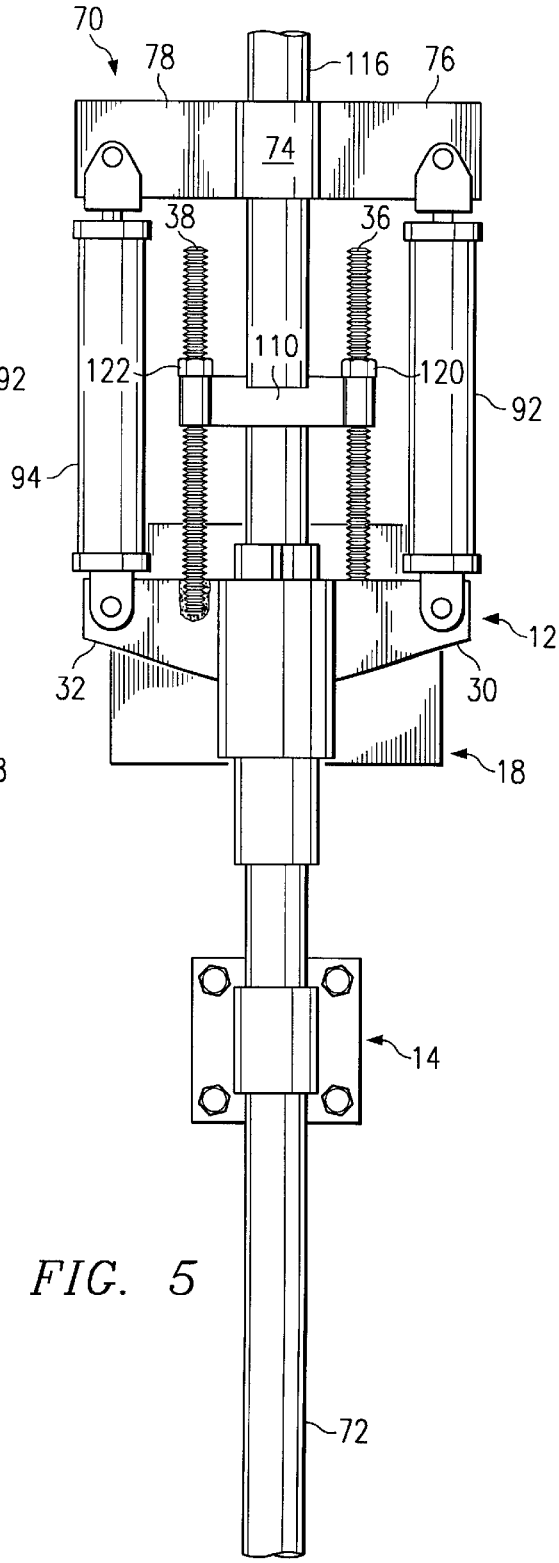

A pair of nuts 120 and 122 are then advanced downwardly over rods 36 and 38, respectively, until nuts 120 and 122 engage support member 110 to secure system 10 in the position illustrated in FIG. 5. Ram units 92 and 94 along with clamp assembly 70 and pipe segment 116 may then be removed.

As stated above, although only one system 10 is illustrated, it is understood that several systems may be used at once at different locations about the pier-supported structure depending upon the extent of support and/or lifting required for the pier-supported structure. In this context, after all of the pilings 72 associated with the respective systems 10 have been driven into the ground until predetermined resistance is encountered, ram units 92 and 94 associated with the piling 72 are simultaneously actuated as described above to uniformly raise or support piers 25 and therefore the pier-supported structure.

Figure 6:
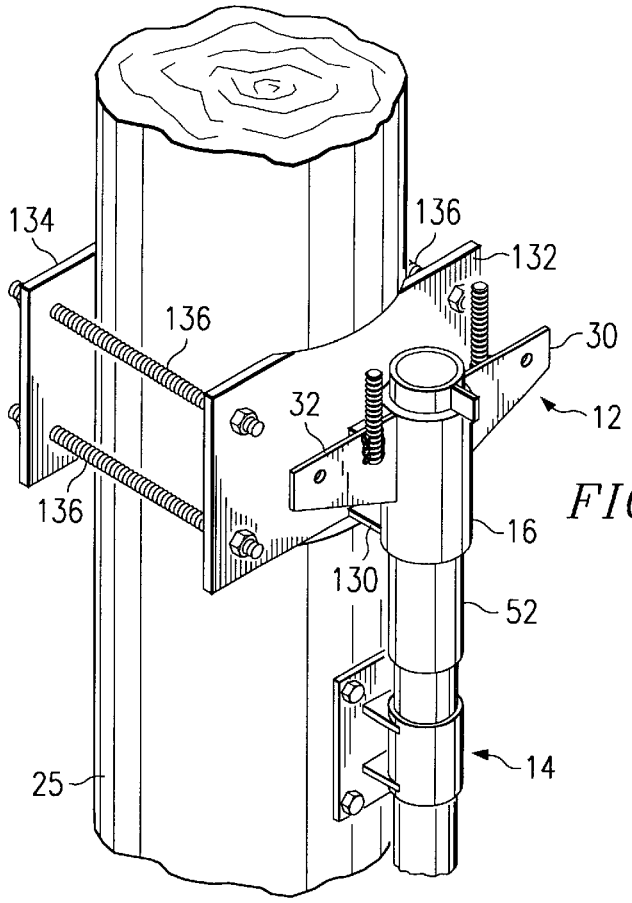
FIGS. 6–7 are diagrams illustrating a pier-support assembly in accordance with another embodiment of the present invention.
Figure 7:
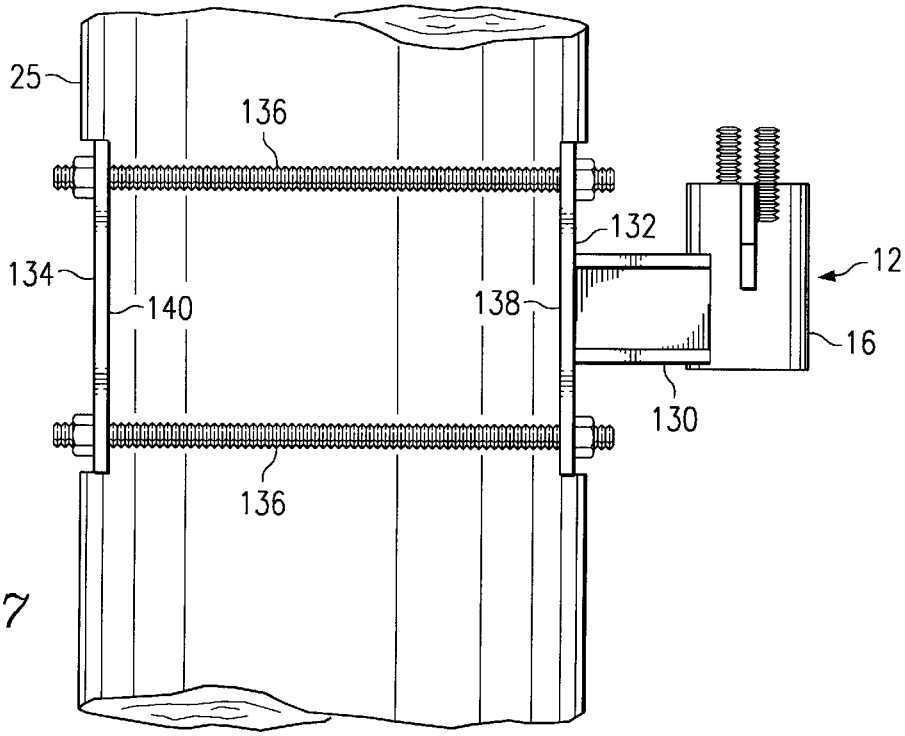

FIGS. 6–7 are diagrams illustrating system 10 in accordance with another embodiment of the present invention. In this embodiment, pier support assembly 12 comprises a support arm 130 coupled to support sleeve 16. Support arm 130 extends substantially perpendicular to support sleeve 16 and outwardly from support sleeve 16 toward pier 25. Support arm 130 may comprise an I-Beam or other type of support configuration and may be coupled to support sleeve 16 by welding or other suitable attachment methods.

As illustrated in FIGS. 6–7, pier support assembly 12 also comprises a mounting plate 132 coupled to support arm 130 and a mounting plate 134. Mounting plate 132 is disposed substantially perpendicular to support arm 130 and may be coupled to support 130 by welding or other suitable attachment methods. Mounting plate 134 is disposed on a side of pier 25 substantially opposite a location of mounting plate 132 and coupled to mounting plate 132 using fasteners 136. However, other suitable devices or methods may be used to couple mounting plate 134 to mounting plate 132.

In operation, attachment profiles 138 and 140 are formed in pier 25 to correspond with configurations of mounting plates 132 and 134, respectively. For example, as illustrated in FIGS. 6–7, pier 25 comprises a generally circular configuration. Thus, attachment profiles 138 and 140 may comprise notches or planar surfaces formed in pier 25 to correspond with generally planar mounting plates 132 and 134. However, other suitable attachment profiles may be formed in pier 25 to accommodate corresponding profiles of mounting plates 132 and 134.

In this embodiment, pier support assembly 12 is coupled to pier 25 by disposing mounting plates 132 and 134 adjacent pier 25 and securing mounting plate 134 to mounting plate 132 using fasteners 136. In this embodiment, fasteners 136 extend outside of pier 25 to couple mounting plate 134 to mounting plate 132; however, pier support assembly 12 may also be constructed such that fasteners 136 extend through pier 25. Thus, the present invention provides increased flexibility than prior systems and methods by accommodating a variety of pier 25 geometric configurations.

Figure 8:
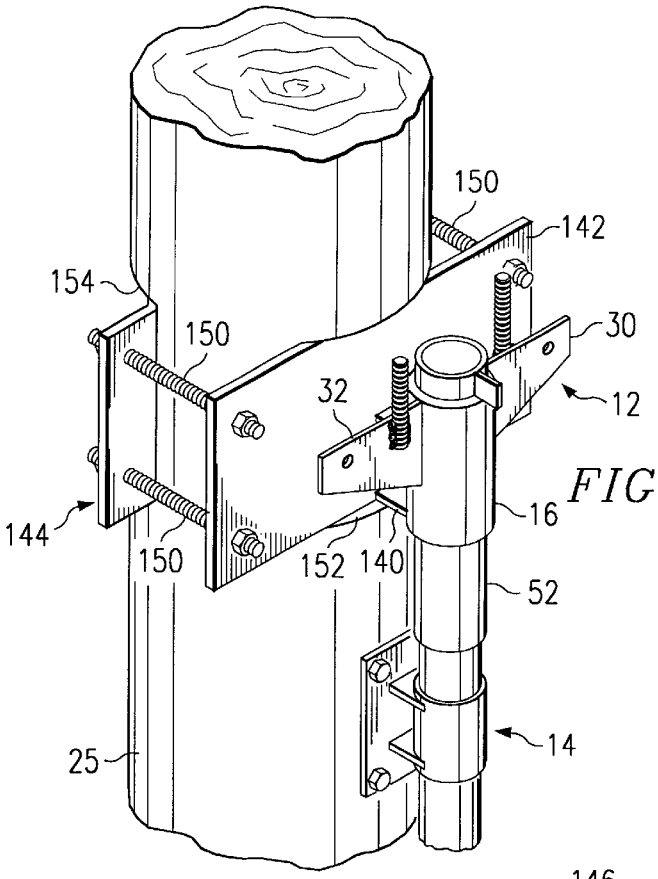
FIGS. 8–9 are diagrams illustrating a pier support assembly in accordance with another embodiment of the present invention.
Figure 9:
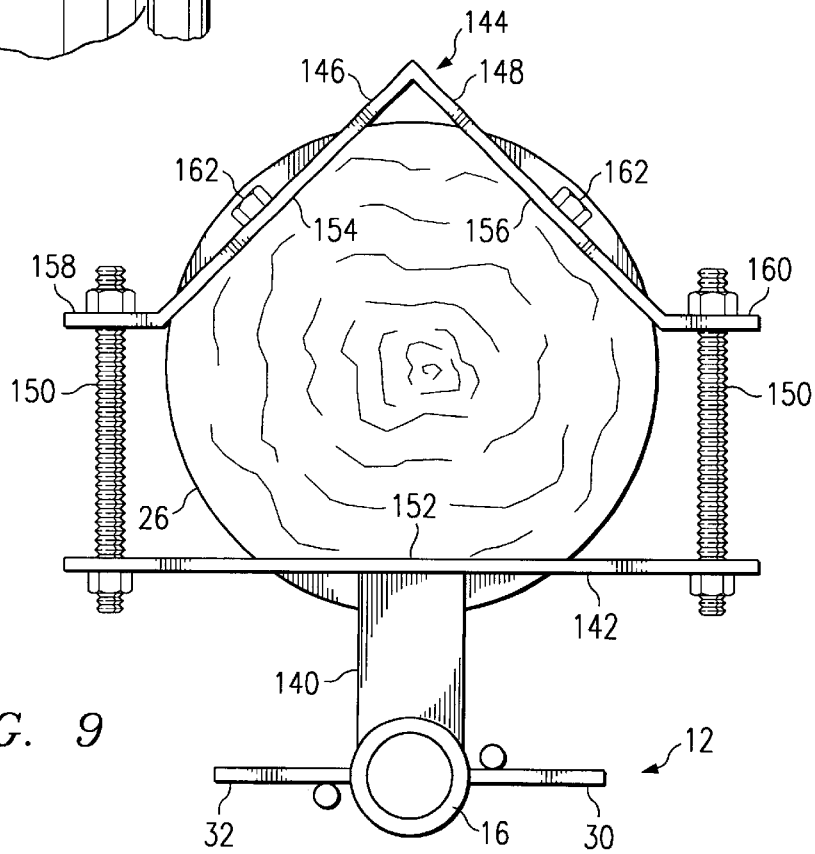

FIGS. 8–9 a diagrams illustrating system 10 in accordance with another embodiment of the present invention. In this embodiment, as illustrated in FIGS. 8–9, pier 25 comprises a generally circular configuration. Additionally, pier support assembly 12 comprises a support arm 140 extending outwardly from, and substantially perpendicular to, support sleeve 16. Pier support assembly 12 also comprises a mounting plate 142 coupled to support arm 140 and a mounting plate 144 disposed on a side of pier 25 substantially opposite mounting plate 142.

In this embodiment, mounting plate 144 comprises plate members 146 and 148 disposed at an angular relationship relative to each other. Depending on the diameter of pier 25, the angular relationship between plate members 146 and 148 may be acute, generally indicating a pier 25 of relatively small diameter, or obtuse, generally indicating a pier 25 having a greater diameter. Mounting plate 144 is coupled to mounting plate 142 using fasteners 150. However, other suitable methods or devices may be used to couple mounting plate 144 to mounting plate 142.

In operation, attachment profiles 152, 154 and 156 are formed in pier 25 to correspond with the geometric configuration of mounting plate 142 and plate members 144 and 148, respectively. For example, attachment profiles 152, 154 and 156 may comprise notches or planar recesses formed in pier 25 to accommodate generally planar configurations of mounting plate 142 and plate members 146 and 148, respectively. However, other suitable attachment profiles may be formed in pier 25 to accommodate other geometric configurations of mounting plates 142 and 144. Additionally, it should be understood that attachment profiles 152, 154 and 156 may be omitted for geometric configurations of mounting plates 142 and 144 substantially similar to a geometric configuration of pier 25.

Mounting plate 144 is coupled to mounting plate 142 by extending fasteners 150 through plate extensions 158 and 160 of mounting plate 144 and coupling fasteners 150 to mounting plate 142. In this embodiment, fasteners 150 are disposed adjacent pier 25. Additionally, fasteners 162 may be installed through plate members 154 and 156, and into pier 25, such as lag bolts or other suitable fastener types. Thus, the present invention provides greater flexibility than prior systems and methods by accommodating a variety of attachment techniques of pier support assembly 12 to pier 25.

Figure 10:
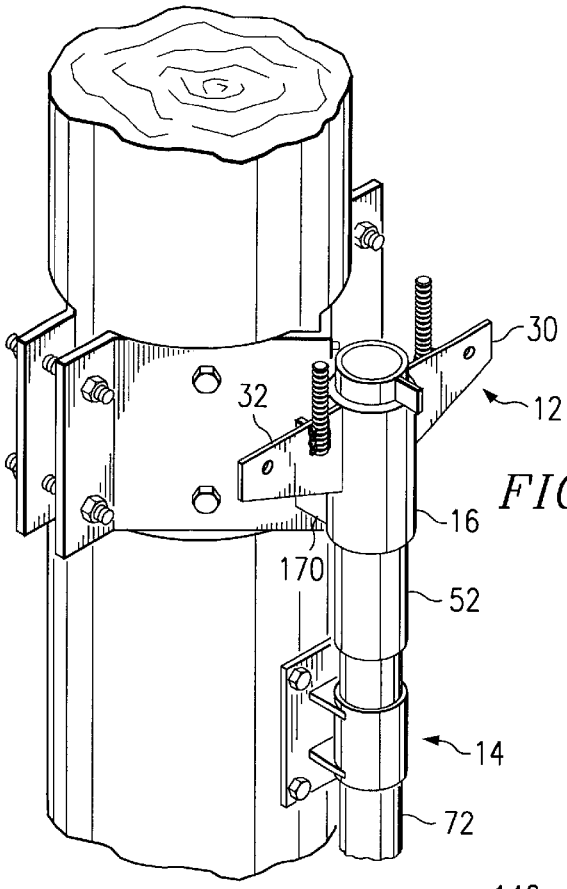
FIGS. 10–11 are diagrams illustrating a pier support assembly in accordance with another embodiment of the present invention.
Figure 11:
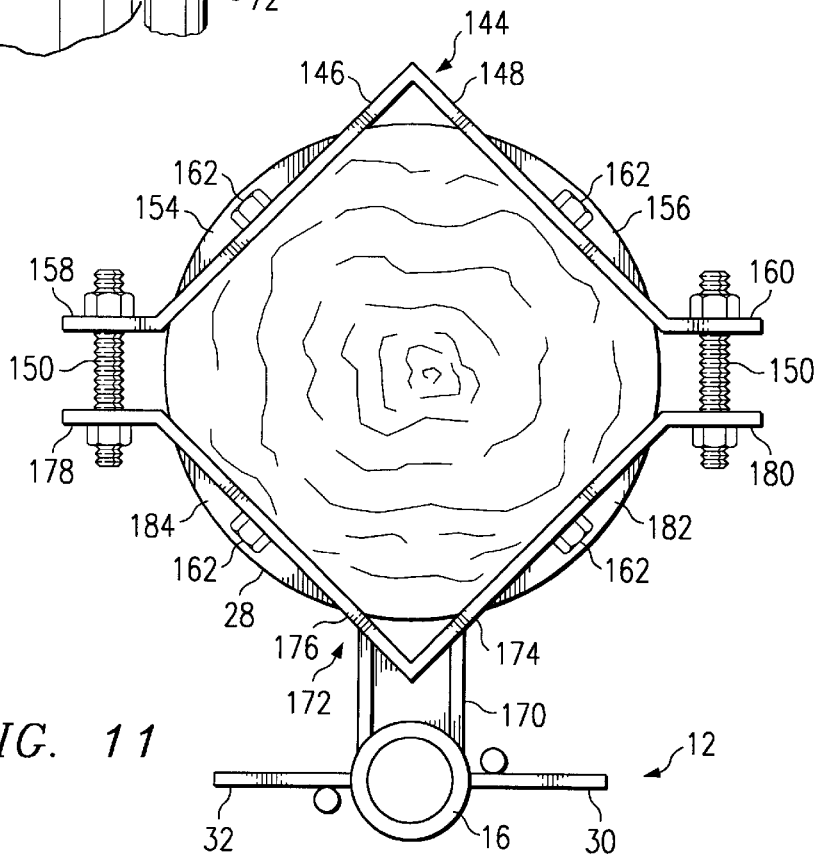

FIGS. 10–11 are diagrams illustrating system 10 in accordance with another embodiment of the present invention. In this embodiment, pier support assembly 12 comprises a support arm 170 extending outwardly from support sleeve 16 toward pier 25 and disposed substantially perpendicular to support sleeve 16. Support arm 170 may comprise an I-Beam support; however, other suitable configurations of a support member may be used for support arm 170.

Pier support assembly 12 also comprises a mounting plate 172 coupled to support arm 170 and mounting plate 144 coupled to mounting plate 172. Mounting plate 144 is secured to mounting plate 172 using fasteners 150. However, other suitable devices or methods may be used to couple mounting plate 144 to mounting plate 172.

In this embodiment, mounting plate 172 comprises plate members 174 and 176 disposed at an angular relationship relative to each other. As described above, in connection with FIGS. 8–9, the angular relationship between plate members 174 and 176 may be acute, obtuse, or substantially 90 degrees depending upon the diameter of pier 25. Mounting plate 172 also comprises plate extensions 178 and 180 to accommodate the attachment of fasteners 150 corresponding to plate extensions 158 and 160, respectively, of mounting plate 144.

In operation, attachment profiles 154 and 156 are formed in pier 25 to accommodate the geometric configuration of plate members 146 and 148. Similarly, attachment profiles 182 and 184 are formed in pier 25 corresponding to the locations of plate members 174 and 176, respectively, to accommodate the geometric configuration of mounting plate 172. For example, attachment profiles 182 and 184 may comprise a notch or planar recess to accommodate a generally planar configuration of plate members 174 and 176. However, attachment profiles 182 and 184 may comprise other suitable configurations to accommodate corresponding geometric configurations of plate members 174 and 176.

As illustrated in FIGS. 10–11, plate members 182 and 184 are disposed on sides of pier 25 substantially opposite the locations of plate members 146 and 148, respectively. Fasteners 162 are used to couple plate members 146, 148, 174 and 176 to pier 25. Thus, the present invention provides greater flexibility than prior systems and methods by providing a variety of attachment techniques of pier support assembly 12 to pier 25. Additionally, the attachment configuration of pier support assembly 12 may be varied to accommodate decreased material removal from pier 25 to substantially prevent a degradation of support integrity of pier 25. For example, as illustrated in FIGS. 8–11, mounting plates 144 and 172 may be constructed to accommodate minimal material removal from pier 25 for attachment profiles 154, 156, 182 and 184 while providing attachment of pier support assembly 12 to pier 25.

Figure 12:
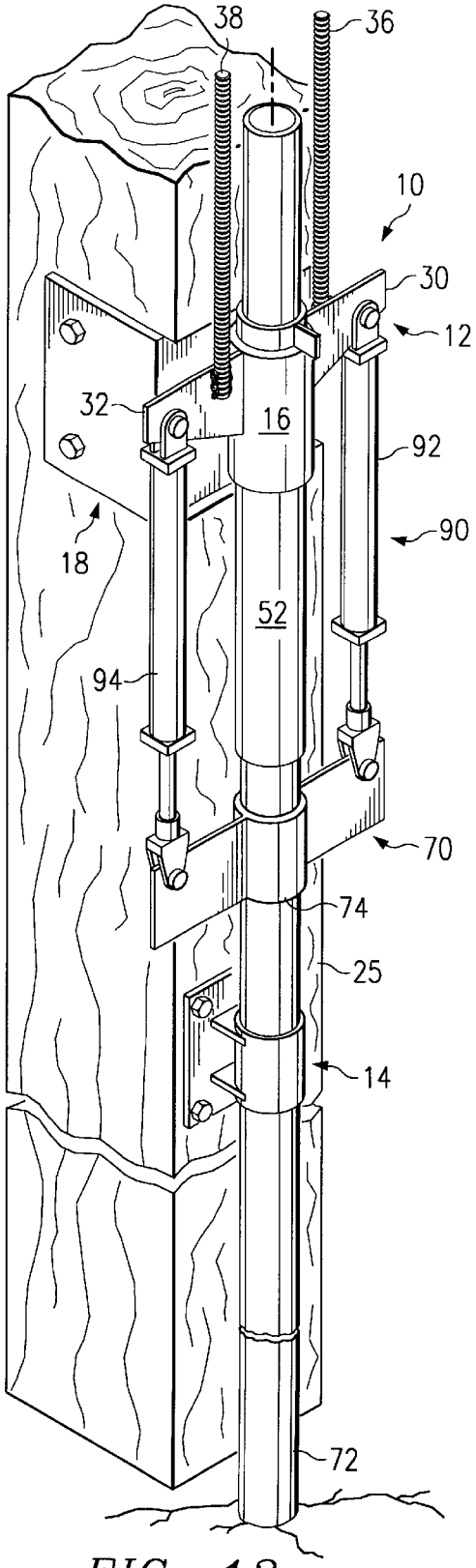
FIG. 12 is a diagram illustrating a system for supporting and lifting a pier-supported structure in accordance with another embodiment of the present invention.

FIG. 12 is a diagram illustrating system 10 for supporting and lifting a pier-supported structure in accordance with another embodiment of the present invention. In this embodiment, clamp assembly 70 and drive system 90 are disposed downwardly relative to pier support assembly 12. For example, clamp assembly 70 may be disposed over piling 72 such that downward movement of clamp assembly 70 causes clamp assembly to grab or clamp piling 72 to drive piling 72 downward. Accordingly, as described above, the arcuate inserts of clamp assembly 70 clamp or grab piling 72 during downward movement of clamp assembly 72 and allow slidable movement of clamp assembly 72 relative to piling 72 in the upwardly direction. Thus, in this embodiment, actuation of ram units 92 and 94 from a retracted position to an extended position force piling 72 into the ground.

Figure 13:
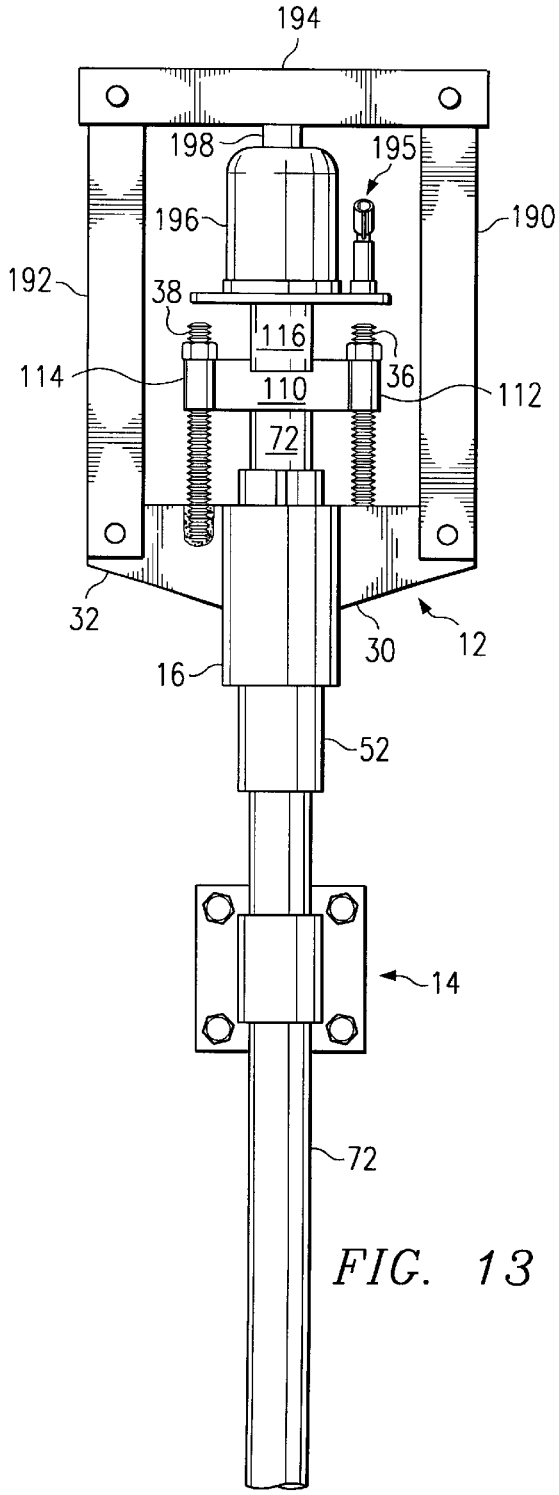
FIG. 13 is a diagram illustrating a system for supporting and lifting a pier-supported structure in accordance with another embodiment of the present invention.

FIG. 13 is a diagram illustrating system 10 for supporting and lifting the pier-supported structure in accordance with another embodiment of the present invention. As illustrated in FIG. 13, system 10 is depicted at a stage of operation such that piling 72 can no longer be driven downwardly due to predetermined resistance encountered, such as by the bedrock. Thus, at this stage of operation, pier 25 may be lifted a desired amount causing pier support assembly 12 and standoff assembly 14 to move upwardly relative to piling 72.

As described above, after the predetermined resistance is encountered, the upper portion of piling 72 is removed such that a relatively short portion thereof extends above the upper end of guide assembly 52. Support member 110 is positioned over the upper end of piling 72 with sleeves 112 and 114 extending over rods 36 and 38, respectively. Drive pipe segment 116 is then placed over support member 110.

In this embodiment, supports 190 and 192 are coupled to attachment plates 30 and 32, respectively, and extend upwardly therefrom. A support 194 is coupled to, and extends between, the upward portions of supports 190 and 192. A drive system 195, in this embodiment, comprises a single hydraulic ram unit 196 disposed between an upper portion of drive pipe segment 116 and support 194. Ram unit 196 includes a piston arm 198 extending upwardly therefrom and in contact with a lower portion of support 194 such that actuation of ram unit 196 causes arm 198 to exert an upwardly directed force to support 194 as arm 198 is actuated from a retracted position to an extended position.

In operation, since piling 72 can no longer be driven downwardly due to the predetermined resistance encountered, such as by the bedrock, the upwardly directed force provided by ram unit 196 causes pier support assembly 12, standoff assembly 14 and pier 25 to move upwardly relative to piling 72, support member 110, pipe segment 116 and the ground. Nuts 120 and 122 are then advanced downwardly over rods 36 and 38, respectively, until nuts 120 and 122 engage support member 110 to secure system 10 in a desired position. Ram unit 196 along with supports 190, 192 and 194 and pipe segment 116 may then be removed.

Figure 14:
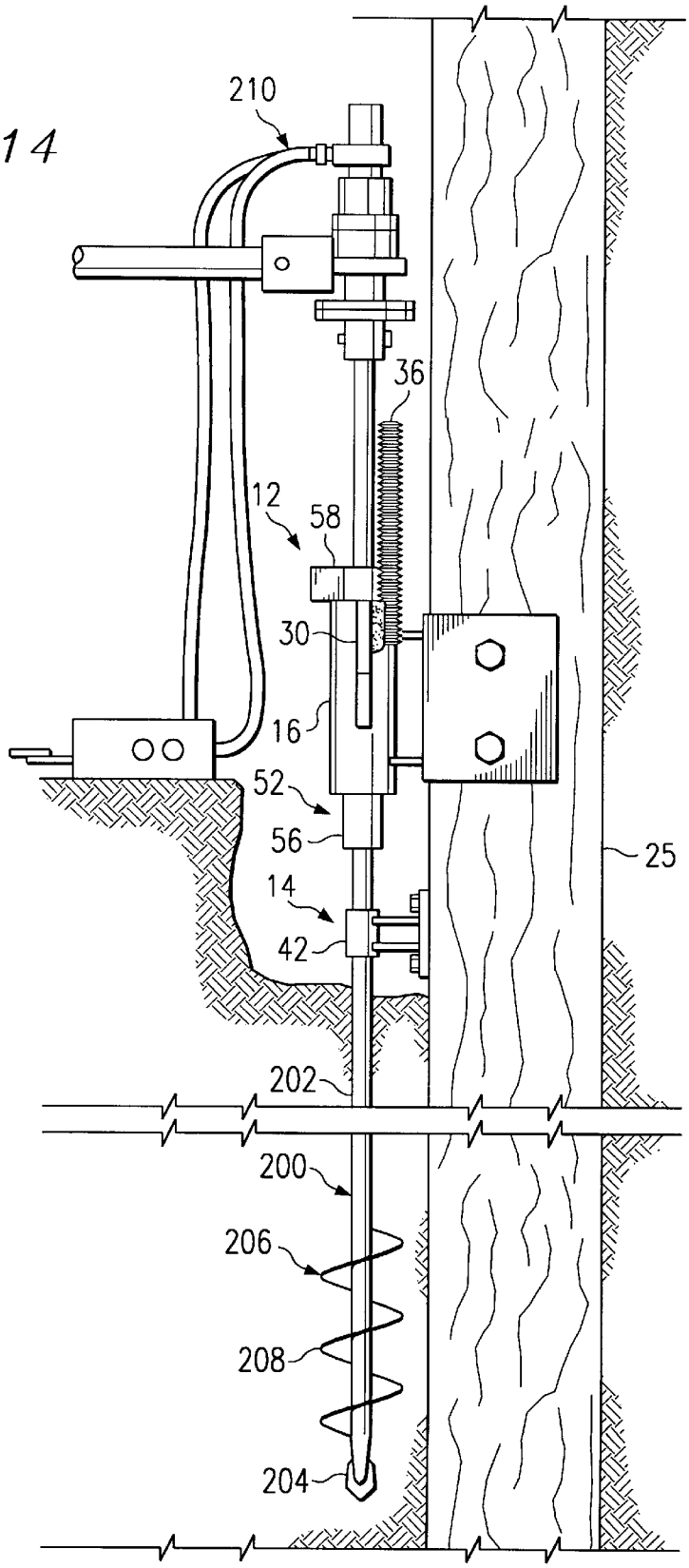
FIG. 14 is a diagram illustrating a system for supporting and lifting a pier-supported structure in accordance with another embodiment of the present invention.

FIG. 14 is a diagram illustrating system 10 for supporting a pier-supported structure in accordance with another embodiment of the present invention. In this embodiment, an earth anchor 200 extends downwardly through support sleeve 16 of pier support assembly 12 and support sleeve 42 of standoff assembly 14 into the ground. Earth anchor 200 includes an anchor shaft 202 having a generally circular cross-section to correspond to a generally circular cross-section of support sleeves 16 and 42. Earth anchor 200 also includes an earth penetrating tip 204 and a helix portion 206 secured to shaft 202 adjacent tip 204. Helix portion 206 includes helix discs 208 for penetrating the ground and load-bearing support relative to the ground.

In operation, a hydraulic motor and gear reduction device 210 or other suitable actuating mechanism is used to rotate the anchor 200 into the ground. The anchor 200 is rotated into the ground to a desired depth. The desired depth may be related to a torque value of the anchor 200, the load-bearing conditions of the soil surrounding the pier 25, the quantity and size of the helix discs 208, the depth to a bedrock formation, or other load-bearing criteria for supporting and lifting the pier-supported structure. For example, the size and quantity of helix discs 208 may be varied to accommodate a variety of load-bearing conditions. Thus, shallow depth load-bearing may be achieved using a greater quantity and size of helix discs 208.

After the desired depth for the anchor 200 is reached, rotation of the anchor 200 may be terminated and the device 210 disengaged from the anchor 200. A portion of the anchor extending above the pier support assembly 12 may be removed such that a relatively short portion thereof, generally a few inches, extends above the upper end of the pier support assembly 12. The pier 25 may then be supported and/or lifted a desired amount as described above in connection with FIGS. 4–5 and 13. Thus, anchor 200 may be used in accordance with the present invention to accommodate variations in the load-bearing strata and/or variations in depth to load-bearing bedrock formations.

Although the present invention has been described with several embodiments, various changes and modifications may be suggested to one skilled in the art. It is intended that the present invention encompass such changes and modifications as falling within the scope of the appended claims.

What is claimed is:

1. A system for supporting a pier-supported structure, comprising:

a pier support assembly for engaging a pier of the structure, the pier support assembly operable to apply a generally horizontal compressive force to the pier;

a guide assembly coupled to the pier support assembly;

a piling extending through the guide assembly;

a clamp assembly adapted to engage the piling upon downward movement of the piling; and a drive system coupled to the clamp assembly and the pier support assembly, the drive system operable to drive the piling downward relative to the pier support assembly until the piling encounters a predetermined resistance.

2. The system of claim 1, wherein the drive system is further operable to raise the pier a predetermined distance relative to the ground after the piling encounters the predetermined resistance.

3. The system of claim 1, wherein the piling comprises a first portion extending upwardly relative to the guide assembly and a second portion extending downwardly relative to the guide assembly, and wherein the clamp assembly is adapted to engage the first portion of the piling upon downward movement of the piling.

4. The system of claim 3, wherein the drive system comprises at least one ram unit operable to retract from an extended position to drive the piling downward relative to the pier support assembly.

5. The system of claim 4, wherein the pier support assembly comprises at least one attachment plate extending outwardly from the guide assembly, and wherein the ram unit is coupled to the attachment plate and the clamp assembly.

6. The system of claim 1, wherein the clamp assembly is disposed between the pier support assembly and the ground, and wherein the drive system comprises at least one ram unit operable to extend from a retracted position to drive the piling downward relative to the pier support assembly.

7. The system of claim 1, further comprising a standoff assembly for engaging a portion of the pier, the standoff assembly disposed in a spaced apart relationship relative to the pier support assembly, the standoff assembly adapted to receive the piling and stabilize the pier support assembly relative to the pier.

8. The system of claim 1, wherein the pier support assembly comprises:

an arm extending substantially perpendicular to the guide assembly;

a first mounting plate coupled to the arm and adapted for engagement with a first portion of the pier; and a second mounting plate adapted for engagement with a second portion of the pier and coupled to the first mounting plate.

9. The system of claim 8, wherein the second mounting plate comprises:

a first plate member adapted for engagement with the pier; and a second plate member adapted for engagement with the pier, the second plate member disposed at an angular relationship relative to the first plate member.

10. The system of claim 9, wherein the first mounting plate comprises:

a first plate member adapted for engagement with the pier; and a second plate member adapted for engagement with the pier, the second plate member of the first mounting plate disposed at an angular relationship relative to the first plate member of the first mounting plate.

11. The system of claim 10, wherein the first plate member of the first mounting plate and the first plate member of the second mounting plate are disposed on substantially opposing surfaces of the pier.

12. A system for supporting a pier-supported structure, comprising:

a pier support assembly for engaging a pier of the structure;

a guide assembly coupled to the pier support assembly;

a piling extending through the guide assembly;

a clamp assembly adapted to engage the piling upon downward movement of the piling;

a drive system coupled to the clamp assembly and the pier support assembly, the drive system operable to drive the piling downward relative to the pier support assembly until the piling encounters a predetermined resistance; and wherein the pier support assembly comprises a channel having opposing sidewalls for engaging corresponding opposing sides of the pier.

13. A system for supporting a pier-supported structure, comprising:

a pier support assembly for engaging a pier of the structure;

a guide assembly coupled to the pier support assembly;

a piling extending through the guide assembly;

a clamp assembly adapted to engage the piling upon downward movement of the piling;

a drive system coupled to the clamp assembly and the pier support assembly, the drive system operable to drive the piling downward relative to the pier support assembly until the piling encounters a predetermined resistance; and wherein the pier support assembly comprises:

a support sleeve adapted for engagement with the guide assembly; and a channel coupled to the support sleeve and having a plurality of opposing sidewalls for engaging corresponding opposing sides of the pier.

14. The system of claim 13, further comprising a standoff assembly disposed in a spaced apart relationship relative to the pier support assembly and operable to engage the pier to stabilize the pier support assembly relative to the pier.

15. The system of claim 14, wherein the standoff assembly comprises a support sleeve disposed in a coaxial relationship relative to the support sleeve of the pier support assembly, the support sleeve of the standoff assembly adapted to receive the piling.

16. A system for supporting a pier-supported structure, comprising:

a pier support assembly for engaging a pier of the structure;

a guide assembly coupled to the pier support assembly;

a piling extending through the guide assembly;

a clamp assembly adapted to engage the piling upon downward movement of the piling;

a drive system coupled to the clamp assembly and the pier support assembly, the drive system operable to drive the piling downward relative to the pier support assembly until the piling encounters a predetermined resistance; and wherein the pier support assembly comprises:

an arm extending substantially perpendicular to the guide assembly;

a first mounting plate coupled to the arm and adapted for engagement with a first portion of the pier;

a second mounting plate adapted for engagement with a second portion of the pier and coupled to the first mounting plate; and wherein the first and second portion of the pier comprise first and second opposing surfaces of the pier.

17. A method for supporting a pier-supported structure, comprising:

securing a pier support assembly to a pier of the structure;

applying a generally horizontal compressive force to the pier via the pier support assembly;

inserting a piling through a support sleeve of the pier support assembly;

coupling a clamp assembly to the piling, the clamp assembly operable to engage the piling upon downward movement of the piling;

coupling a drive system to the clamp assembly and the pier support assembly; and actuating the drive system to drive the piling downward relative to the pier support assembly until the piling encounters a predetermined resistance.

18. The method of claim 17, further comprising:

inserting a guide assembly into the support sleeve of the pier support assembly prior to inserting the piling into the support sleeve; and inserting the piling into the guide assembly.

19. The method of claim 17, wherein coupling the clamp assembly to the piling comprises:

positioning the clamp assembly upwardly relative to the pier support assembly; and inserting the piling into a sleeve of the clamp assembly; and wherein actuating the drive system comprises retracting a ram unit from an extended position to drive the piling downward relative to the pier support system.

20. The method of claim 17, wherein actuating the drive system comprises extending a ram unit from a retracted position to drive the piling downward relative to the pier support system.

21. The method of claim 17, further comprising:

securing a standoff assembly to the pier, the standoff assembly disposed in a spaced apart relationship relative to the pier support assembly; and inserting the piling through a support sleeve of the standoff assembly.

22. The method of claim 17, further comprising lifting the pier support assembly and the pier relative to the ground after encountering the predetermined resistance.

23. A method for supporting a pier-supported structure, comprising:

securing a pier support assembly to a pier of the structure;

inserting a piling through a support sleeve of the pier support assembly;

coupling a clamp assembly to the piling, the clamp assembly operable to engage the piling upon downward movement of the piling;

positioning the clamp assembly downwardly relative to the pier support assembly;

inserting the piling into a sleeve of the clamp assembly;

coupling a drive system to the clamp assembly and the pier support assembly; and actuating the drive system to drive the piling downward relative to the pier support assembly until the piling encounters a predetermined resistance.

24. A method for supporting a pier-supported structure, comprising:

forming an attachment profile in a portion of a pier of the structure;

coupling a pier support assembly to the pier corresponding to the attachment profile;

inserting a piling through a support sleeve of the pier support assembly;

coupling a clamp assembly to the piling, the clamp assembly operable to engage the piling upon downward movement of the piling;

coupling a drive system to the clamp assembly and the pier support assembly; and actuating the drive system to drive the piling downward relative to the pier support assembly until the piling encounters a predetermined resistance.

25. The method of claim 24, wherein the attachment profile comprises a notch formed on a surface of the pier.

26. A method for supporting a pier-supported structure, comprising:

securing a pier support assembly to a pier of the structure;

inserting a piling through a support sleeve of the pier support assembly;

coupling a clamp assembly to the piling, the clamp assembly operable to engage the piling upon downward movement of the piling;

coupling a drive system to the clamp assembly and the pier support assembly;

actuating the drive system to drive the piling downward relative to the pier support assembly until the piling encounters a predetermined resistance; and wherein securing the pier support assembly to the pier comprises:

positioning a channel of the pier support assembly adjacent the pier such that opposing sidewalls of the channel engage corresponding opposing sides of the pier; and securing the sidewalls of the channel to the pier.

27. The method of claim 26, further comprising forming an attachment profile in a portion of the pier, and wherein positioning the channel comprises positioning a base member of the channel adjacent the pier corresponding to the attachment profile.

28. A method for supporting a pier-supported structure, comprising:

securing a pier support assembly to a pier of the structure;

inserting a piling through a support sleeve of the pier support assembly;

coupling a clamp assembly to the piling, the clamp assembly operable to engage the piling upon downward movement of the piling;

coupling a drive system to the clamp assembly and the pier support assembly;

actuating the drive system to drive the piling downward relative to the pier support assembly until the piling encounters a predetermined resistance; and wherein securing the pier support assembly to the pier comprises:

positioning a first mounting plate adjacent the pier;

positioning a second mounting plate on an opposite side of the pier relative to the first mounting plate; and securing the first mounting plate to the second mounting plate.

29. The method of claim 28, further comprising:

forming a first attachment profile in the pier corresponding to a location of the first mounting plate; and forming a second attachment profile in the pier corresponding to a location of the second mounting plate; and wherein positioning the first and second mounting plates comprises positioning the first and second mounting plates adjacent the respective first and second attachment profiles.

30. A system for supporting a pier-supported structure, comprising:

a support sleeve disposed in a spaced apart relationship relative to a pier of the structure, the support sleeve adapted for receiving a piling;

a channel coupled to the support sleeve and adapted for engagement with a vertical side of the pier;

a clamp assembly adapted to engage the piling upon downward movement of the piling;

a drive system coupled to the clamp assembly and the support sleeve, the drive system operable to drive the piling downward relative to the support sleeve until the piling encounters a predetermined resistance; and wherein the channel comprises opposing sidewalls adapted for engagement with corresponding opposing sides of the pier.

31. The system of claim 30, further comprising a guide assembly disposed within the support sleeve, the guide assembly adapted for receiving the piling.

32. The system of claim 30, wherein the drive system is further operable to raise the support sleeve and the pier a predetermined distance relative to the ground after the piling encounters the predetermined resistance.

33. The system of claim 30, wherein the piling comprises a first portion extending upwardly relative to the support sleeve and a second portion extending downwardly relative to the support sleeve, and wherein the clamp assembly is adapted to engage the first portion of the piling upon downward movement of the piling.

34. The system of claim 33, wherein the drive system comprises at least one ram unit operable to retract from an extended position to drive the piling downward relative to the support sleeve.

35. The system of claim 34, further comprising an attachment plate coupled to the support sleeve and extending outwardly substantially perpendicular to the piling, and wherein the ram unit is coupled to the attachment plate and the clamp assembly.

36. The system of claimed 30, further comprising a standoff assembly disposed in a spaced apart relationship relative to the support sleeve and adapted to receive the piling, the standoff assembly operable to engage the pier to stabilize the support sleeve relative to the pier.

37. The system of claim 30, further comprising:

a plurality of rods coupled to the support sleeve, the rods extending upwardly from the support sleeve; and a plate operable to engage the rods and secure the support sleeve at a predetermined position relative to the ground.

38. A system for supporting a pier-supported structure, comprising:

a support sleeve disposed in a spaced apart relationship relative to a pier of the structure, the support sleeve adapted for receiving a piling;

a channel coupled to the support sleeve and adapted for engagement the pier;

a clamp assembly adapted to engage the piling upon downward movement of the piling;

a drive system coupled to the clamp assembly and the support sleeve, the drive system operable to drive the piling downward relative to the support sleeve until the piling encounters a predetermined resistance; and wherein the clamp assembly is disposed between the support sleeve and the ground, and wherein the drive system comprises at least one ram unit operable to extend from a retracted position to drive the piling downward relative to the support sleeve.

39. A system for supporting a pier-supported structure, comprising:

a support sleeve disposed in a spaced apart relationship relative to a pier of the structure, the support sleeve adapted for receiving a piling;

a support arm coupled to the support sleeve and extending outwardly toward the pier;

a first mounting plate coupled to the support arm and disposed adjacent the pier;

a second mounting plate coupled to the first mounting plate, the second mounting plate disposed on an opposing side of the pier relative to the first mounting plate;

a clamp assembly adapted to engage the piling upon downward movement of the piling;

a drive system coupled to the clamp assembly and the support sleeve, the drive system operable to drive the piling downward relative to the support sleeve until the piling encounters a predetermined resistance.

40. The system of claim 39, wherein the second mounting plate comprises:

a first plate member coupled to the pier; and a second plate member coupled to the pier, the first plate member disposed in an angular position relative to the second plate member.

41. The system of claim 40, wherein the first mounting plate comprises:

a first plate member coupled to the pier; and a second plate member coupled to the pier, the first plate member of the first mounting plate disposed in an angular position relative to the second plate member of the first mounting plate.

42. The system of claim 41, wherein the first plate member of the first mounting plate in disposed on an opposite side of the pier relative to the first plate member of the second mounting plate.

43. The system of claim 39, further comprising a guide assembly disposed within the support sleeve, the guide assembly adapted for receiving the piling.

44. The system of claim 39, wherein the drive system is further operable to raise the support sleeve and the pier a predetermined distance relative to the ground after the piling encounters the predetermined resistance.

45. The system of claim 39, wherein the piling comprises a first portion extending upwardly relative to the support sleeve and a second portion extending downwardly relative to the support sleeve, and wherein the clamp assembly is adapted to engage the first portion of the piling upon downward movement of the piling.

46. The system of claim 45, wherein the drive system comprises at least one ram unit operable to retract from an extended position to drive the piling downward relative to the support sleeve.

47. The system of claim 46, further comprising an attachment plate coupled to the support sleeve and extending outwardly substantially perpendicular to the piling, and wherein the ram unit is coupled to the attachment plate and the clamp assembly.

48. The system of claim 39, further comprising a standoff assembly disposed in a spaced apart relationship relative to the support sleeve and adapted to receive the piling, the standoff assembly operable to engage the pier to stabilize the support sleeve relative to the pier.

49. The system of claim 39, wherein the clamp assembly is disposed between the support sleeve and the ground, and wherein the drive system comprises at least one ram unit operable to extend from a retracted position to drive the piling downward relative to the support sleeve.

50. The system of claim 39, further comprising:

a plurality of rods coupled to the support sleeve, the rods extending upwardly from the support sleeve; and a plate operable to engage the rods and secure the support sleeve at a predetermined position relative to the ground.

51. A system for supporting a pier-supported structure, comprising:

a pier support assembly for engaging a pier of the structure, the pier support assembly operable to apply a generally horizontal compressive force to the pier;

a guide assembly coupled to the pier support assembly;

an anchor extending through the guide assembly, the anchor having a helix portion adapted to be embedded into the ground;

a drive system coupled to the anchor and operable to rotate the anchor relative to the pier support assembly to drive the anchor downward relative to the pier support assembly until the anchor reaches a desired depth; and a support member adapted to cooperate with the pier support assembly to secure the anchor at the desired depth relative to the pier support assembly.

52. The system of claim 51, further comprising another drive system coupled to the pier support assembly and operable to raise the pier a predetermined distance relative to the ground after the anchor reaches the desired depth.

53. The system of claim 51, further comprising a standoff assembly for engaging a portion of the pier, the standoff assembly disposed in a spaced apart relationship relative to the pier support assembly, the standoff assembly adapted to receive the anchor and stabilize the pier support assembly relative to the pier.

54. A system for supporting a pier-supported structure, comprising:

a pier support assembly for engaging a pier of the structure;

a guide assembly coupled to the pier support assembly;

an anchor extending through the guide assembly, the anchor having a helix portion adapted to be embedded into the ground;

a drive system coupled to the anchor and operable to rotate the anchor relative to the pier support assembly to drive the anchor downward relative to the pier support assembly until the anchor reaches a desired depth;

a support member adapted to cooperate with the pier support assembly to secure the anchor at the desired depth relative to the pier support assembly; and wherein the pier support assembly comprises a channel having opposing sidewalls for engaging corresponding opposing sides of the pier.

55. A system for supporting a pier-supported structure, comprising:

a pier support assembly for engaging a pier of the structure;

a guide assembly coupled to the pier support assembly;

an anchor extending through the guide assembly, the anchor having a helix portion adapted to be embedded into the ground;

a drive system coupled to the anchor and operable to rotate the anchor relative to the pier support assembly to drive the anchor downward relative to the pier support assembly until the anchor reaches a desired depth;

a support member adapted to cooperate with the pier support assembly to secure the anchor at the desired depth relative to the pier support assembly; and wherein the pier support assembly comprises:

a support sleeve adapted for engagement with the guide assembly; and a channel coupled to the support sleeve and having a plurality of opposing sidewalls for engaging corresponding opposing sides of the pier.

56. The system of claim 55, further comprising a standoff assembly disposed in a spaced apart relationship relative to the pier support assembly and operable to engage the pier to stabilize the pier support assembly relative to the pier.

57. The system of claim 56, wherein the standoff assembly comprises a support sleeve disposed in a coaxial relationship relative to the support sleeve of the pier support assembly, the support sleeve of the standoff assembly adapted to receive the anchor.

58. A system for supporting a pier-supported structure, comprising:

a pier support assembly for engaging a pier of the structure;

a guide assembly coupled to the pier support assembly;

an anchor extending through the guide assembly, the anchor having a helix portion adapted to be embedded into the ground;

a drive system coupled to the anchor and operable to rotate the anchor relative to the pier support assembly to drive the anchor downward relative to the pier support assembly until the anchor reaches a desired depth;

a support member adapted to cooperate with the pier support assembly to secure the anchor at the desired depth relative to the pier support assembly; and wherein the pier support assembly comprises:

an arm extending substantially perpendicular to the guide assembly;

a first mounting plate coupled to the arm and adapted for engagement with a first portion of the pier;

a second mounting plate adapted for engagement with a second portion of the pier and coupled to the first mounting plate; and wherein the first and second portion of the pier comprise first and second opposing surfaces of the pier.

59. A method for supporting a pier-supported structure, comprising:

securing a pier support assembly to a pier of the structure;

applying a generally horizontal compressive force to the pier via the pier support assembly;

disposing an anchor in a support sleeve of the pier support assembly, the anchor having a helix portion adapted to be embedded into the ground;

coupling a drive system to the anchor, the drive system operable to rotate the anchor relative to clamp assembly;

actuating the drive system to drive the anchor downward relative to the pier support assembly to a desired depth; and securing the anchor relative to the pier support assembly to support the structure.

60. The method of claim 59, further comprising:

inserting a guide assembly into the support sleeve of the pier support assembly prior to inserting the anchor into the support sleeve; and inserting the anchor into the guide assembly.

61. The method of claim 59, further comprising:

securing a standoff assembly to the pier, the standoff assembly disposed in a spaced apart relationship relative to the pier support assembly; and inserting the anchor through a support sleeve of the standoff assembly.

62. The method of claim 59, further comprising raising the pier support assembly and the pier relative to the ground and the anchor after the anchor reaches the desired depth.

63. A method for supporting a pier-supported structure, comprising:

forming an attachment profile in a portion of a pier of the structure;

coupling a pier support assembly to the pier corresponding to the attachment profile;

disposing an anchor in a support sleeve of the pier support assembly, the anchor having a helix portion adapted to be embedded into the ground;

coupling a drive system to the anchor, the drive system operable to rotate the anchor relative to clamp assembly;

actuating the drive system to drive the anchor downward relative to the pier support assembly to a desired depth; and securing the anchor relative to the pier support assembly to support the structure.

64. The method of claim 63, wherein the attachment profile comprises a notch formed on a surface of the pier.

65. A method for supporting a pier-supported structure, comprising:

securing a pier support assembly to a pier of the structure;

disposing an anchor in a support sleeve of the pier support assembly, the anchor having a helix portion adapted to be embedded into the ground;

coupling a drive system to the anchor, the drive system operable to rotate the anchor relative to clamp assembly;

actuating the drive system to drive the anchor downward relative to the pier support assembly to a desired depth;

securing the anchor relative to the pier support assembly to support the structure; and wherein securing the pier support assembly to the pier comprises:

positioning a channel of the pier support assembly adjacent the pier such that opposing sidewalls of the channel engage corresponding opposing sides of the pier; and securing the sidewalls of the channel to the pier.

66. The method of claim 65, further comprising forming an attachment profile in a portion of the pier, and wherein positioning the channel comprises positioning a base member of the channel adjacent the pier corresponding to the attachment profile.

67. A method for supporting a pier-supported structure, comprising:

securing a pier support assembly to a pier of the structure;

disposing an anchor in a support sleeve of the pier support assembly, the anchor having a helix portion adapted to be embedded into the ground;

coupling a drive system to the anchor, the drive system operable to rotate the anchor relative to clamp assembly;

actuating the drive system to drive the anchor downward relative to the pier support assembly to a desired depth;

securing the anchor relative to the pier support assembly to support the structure; and wherein securing the pier support assembly to the pier comprises:

positioning a first mounting plate adjacent the pier;

positioning a second mounting plate on an opposite side of the pier relative to the first mounting plate; and securing the first mounting plate to the second mounting plate.

68. The method of claim 67, further comprising:

forming a first attachment profile in the pier corresponding to a location of the first mounting plate; and forming a second attachment profile in the pier corresponding to a location of the second mounting plate; and wherein positioning the first and second mounting plates comprises positioning the first and second mounting plates adjacent the respective first and second attachment profiles.

* * * * *